United States Patent [19]

Krob et al.

[11] 4,025,087

[45] May 24, 1977

[54] SAFETY SKI BINDING

[75] Inventors: Erwin Krob, Vienna; Erwin Weigl, Brunn am Gebirge; Josef Svoboda, Schwechat, all of Austria

[73] Assignee: Gertsch AG, Zug, Switzerland

[22] Filed: June 27, 1975

[21] Appl. No.: 591,032

[30] Foreign Application Priority Data

July 26, 1974 Austria ..... 6181/74

[52] U.S. Cl. ..... 280/631

[51] Int. Cl.[2] ..... A63C 9/08

[58] Field of Search ..... 280/11.35 T, 631, 632

[56] References Cited

UNITED STATES PATENTS

| | | | |
|---|---|---|---|
| 3,733,082 | 5/1973 | Murata et al. | 280/11.35 T |
| 3,836,163 | 9/1974 | Hashioka | 280/11.35 T |
| 3,876,219 | 4/1975 | Smolka | 280/11.35 T |

FOREIGN PATENTS OR APPLICATIONS

| | | |
|---|---|---|
| 296,839 | 6/1971 | Austria |
| 1,703,638 | 2/1972 | Germany |
| 464,037 | 10/1968 | Switzerland |

*Primary Examiner*—Robert R. Song

*Attorney, Agent, or Firm*—Woodhams, Blanchard and Flynn

[57] ABSTRACT

Manual release means for safety ski binding. The sole holder for the forward or rearward end of a ski boot is pivoted to a housing and includes a pin within said housing which moves upwardly and downwardly with opening and closing movement of the sole holder. A pair of tonglike means resiliently embrace said pin for normally holding the sole holder in sole engaging position but are spread apart against an adjustable spring force upon imposition of a predetermined opening force onto the sole engaging means of the device. One side of said tonglike device is directly engaged by one end of the adjusting spring and the other side of said tonglike device is engaged by the reaction means holding the other end of said spring whereby to double the holding strength of the tonglike means for a given spring as compared to a construction in which the spring holds only one side of a pin retaining device. Cam means manually operable by an external lever are placed between the sides of said tonglike means for manually releasing same as desired.

8 Claims, 5 Drawing Figures

SAFETY SKI BINDING

FIELD OF THE INVENTION 1

The invention relates to a safety ski binding, in which the sole holding part is supported pivotally about a pivot axis which is positioned transversely to the longitudinal direction of the ski and against the force of an adjustable spring and wherein the holding spring is supported on a track constructed inside of the sole holder.

BACKGROUND OF THE INVENTION

Safety ski bindings of the above-mentioned type are known in various constructions. In all known devices the correct choice of the release spring is important because the release spring determines the release action. For reasons of shock absorption, the use of long springs is desired, however, these cannot always be used because of limitations of construction. The usual compromise solution, therefore, is the installing of short springs with an appropriate spring characteristic.

The objective of the invention is to overcome these disadvantages and to provide a safety ski binding of the above-mentioned type in which the choice of the spring can be made freely by the designer over a larger range.

SUMMARY OF THE INVENTION

The purpose is attained according to the invention by arranging the track which is provided to support the release spring adjustably in relationship to a holding element. A support member engages the holding element, which support member is coupled with the holding mechanism of the release spring and the holding element is also adjustable in relationship to the track.

The construction of the safety ski binding of the invention provides that the coupled support of the release spring permits a shortening of the spring length, or expressed differently — the effective length of the spring corresponds as a practical matter to a spring which is twice as strong. In this manner the designer can choose the spring characteristic more freely and also in the dimensioning of the spring he has available a greater range of choices.

A particularly advantageous embodiment of the invention is seen in that the adjustable track and the holding element lie substantially parallel to one another in the holding condition of the sole holder and in that the support member is advantageously a rod which extends through the inside of the release members and engages the side of the holding element which is opposite the adjustable track. In this manner, a duplicate control device which opens or closes in a tonglike manner is created, which in relationship to the spring device receives or passes on equal forces.

A further advantageous embodiment of the invention is seen in providing an elliptic release member between track and holding element, which release member can be operated by a handle which is arranged outside of the housing of the ski binding. In this manner a voluntary opening, namely the adjusting of the track or of the holding element upon a simultaneous compression of the release spring, is achieved.

A modification of the invention is characterized by arranging the release member outside of the area of the track and the holding element and by supporting the release member at least against a shoulder, which is fixedly connected to the track and/or to the holding element.

Further advantages and details of the invention will be discussed more in detail in connection with the drawings, in which several exemplary embodiments are illustrated.

BRIEF DESCRIPTION OF THE DRAWINGS

In the drawings:

FIGS. 1 and 2 are associated views of a first exemplary embodiment of the inventive safety ski binding, wherein FIG. 1 is an elevational cross-sectional view and FIG. 2 is a top view.

DETAILED DESCRIPTION

Figure 1:
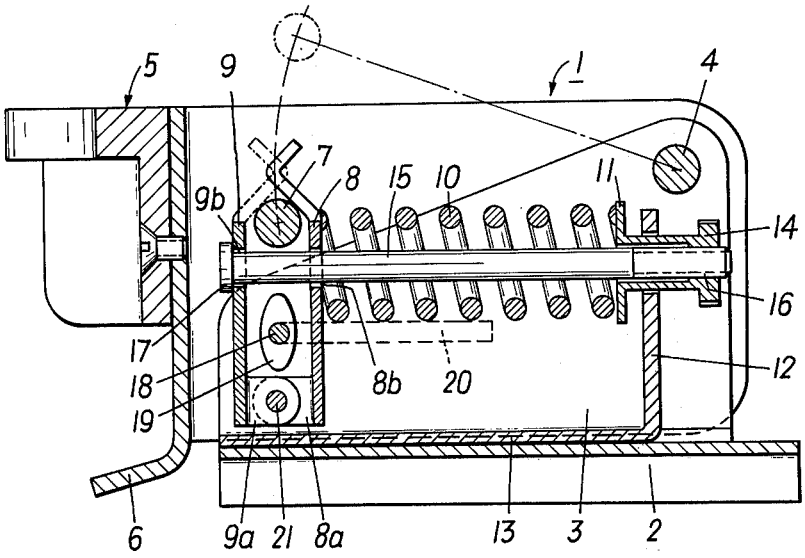

The ski binding which as a whole is identified by reference numeral 1 rests on the ski (not illustrated) with the interpositioning of a separator having a bearing block 3. A pivot axis 4 is arranged transversely to the longitudinal direction of the ski in the bearing block 3, about which axis the sole holder 5 can be pivoted. The sole holder 5 consists of conventional parts which are therefore here not discussed in detail. A projecting spur 6 is provided to operate the sole holder 5.

In the closed position of the ski binding 1, as is shown in FIG. 1, a locking pin 7 which is secured in the sole holder 5 is held by an adjustable track 8 and a holding element 9, which forms a releasable mounting for the locking pin 7 due to the force of a spring. The spring 10 is held at one of its ends by means of a spring disk 11, which is supported on a sleeve 14 which is in turn supported in an upstanding bent part 12 of the holding plate 13 of the ski binding 1. The other end of the spring 10 is supported on the side of the adjustable track 8, which side is remote from the locking pin 7. The spring 10 has a support member 15 extending therethrough, which member is arranged for longitudinal movement by a thread 16 in the sleeve 14 and rests at the opposite end with a head 17 on the side of the holding element 9 remote from the locking pin.

Between the adjustable track 8 and the holding element 9 there is arranged on a locking pin 18 an oval-shaped release member 19 with a handle 20. The handle 20 is secured outside of the sole holder on the locking pin 18 and serves for the voluntary opening of the ski binding 1. In the illustrated horizontal position of the handle 20, the oval-shaped release member 19 is positioned with its small dimension between the track 8 and the holding element 9 and does not affect the closed position of the ski binding 1. If, however, the handle 20 is swung into the position illustrated in FIG. 3, then the large dimension of the release member 19 spreads apart the track 8 and the holding element 9 and by lifting the ski boot (here not illustrated) the sole holder 5 can pivot about the pivot axis 4, because now the force of the spring 10 is cancelled and the locking pin 7 can easily be guided through between track 8 and holding element 9.

Track 8 and holding element 9 have bent holding parts 8*a* or 9*a*, through which extends a pin 21. The adjustment of the track 8 and of the holding element 9 with respect to one another can be easily understood by comparing the two positions shown in FIG. 1 and FIG. 3. From these figures, it is apparent that both the track 8 and also the holding element 9 are each provided with a slotlike opening 8*b* or 9*b*, to assure that the support member 15 can extend through same unhindered also in the tilted position of the track 8 or of the holding element 9. Due to the fact that the end of the support member 15, which end extends into the sleeve 14, has a thread 16 and is held in the sleeve 14, the initial stress of the spring 10 can be changed. Thus, if the support member 15 is pulled toward the eyelet 14, then track 8 and holding element 9 are held together more firmly between the spring 10 and the head 17 than if the tightening of the support member 15 is less.

FIG. 1 also shows the position assumed by the locking pin 7 when the binding is released. The opening of the binding 1 takes place during a fall or the like (automatic release) by the not-illustrated boot trying to pivot the sole holder 5 about the pivot axis 4. In this manner, the locking pin 7 is urged against the force of the spring 10, which acts both through the track 8 and also through the translation which takes place by means of spring plate 11, sleeve 14, support member 15 and head 17 onto the holding element 9. If through the tilted locking pin 7 a greater force is applied by the boot onto the track 8 or the holding element 9 than the holding force of the spring 10, then track 8 and holding element 9 open in a similar manner as is achieved during the voluntary release by the release member and as shown in FIG. 3.

Figure 2:
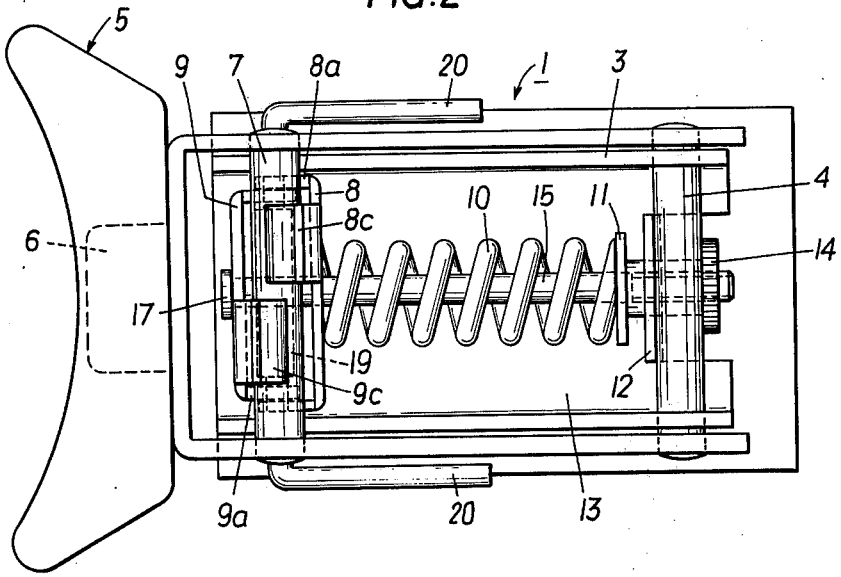
Figure 3:
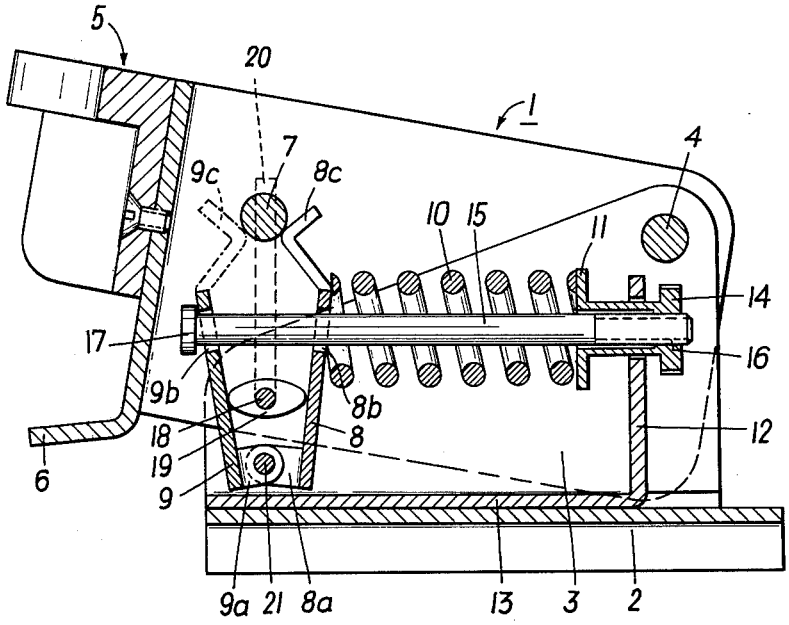
FIG. 3 illustrates the safety ski binding according to FIG. 1 in opened condition.

FIG. 2 illustrates the inventive ski binding 1 in order to be complete in a top view together with the parts already shown in FIGS. 1 and 3. FIG. 2 shows that the track 8 and the holding element 9 engage the locking pin 7 by their respective holding parts 8*c* or 9*c* which are offset to one another. This embodiment is preferred because through this the dimensions of the locking pin 7 may be smaller and still be able to secure the mounting of track 8 and holding element 9. On the other hand, this embodiment permits a great elasticity, because upon the appearance of a load on the foot of the skier and thus on the ski boot, an immediate release does not take place, but the sole holder 5 only adjusts the locking pin 7 against the track 8 or the holding element 9 but said pin 7 still remains in the locked position between these parts. This resilient play is, as is known, of great importance to avoid unnecessary release operations. This distinguishes the inventive ski binding as an advantageous safety ski binding. FIG. 2 shows in addition that the handle 20 can be arranged on both sides of the ski binding 1. Through this a voluntay release may be made possible even after a fall of a skier, if the fall prevents his reaching the one side of the ski binding 1. It can easily be recognized that in general the outer handle 20 will be used, if a voluntary opening of the ski binding 1 after a skiing operation is necessary.

Figure 4:
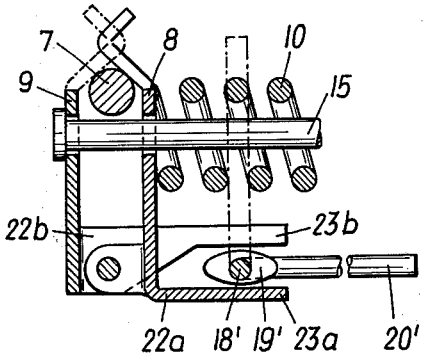

FIG. 4 shows a further embodiment of the arrangement of the handle 20′, which is now arranged in the lower area of the ski binding 1. For this purpose, track 8 and holding element 9 have each one shoulder 22*a*, *b*, which with substantially horizontal end parts 23*a*, *b* grip over the oval-shaped release member l19′, which is pivotal about the locking pin 18′. Here too the closed position of the ski binding is achieved with a substantially horizontally extending handle 20′ and the opening is achived by swinging the handle 20′ upwardly at 90°. The two positions are identified with the words "closed" or "open". Since this figure is used solely to indicate the change in arrangement of the handle 20, the further parts have been omitted.

Figure 5:
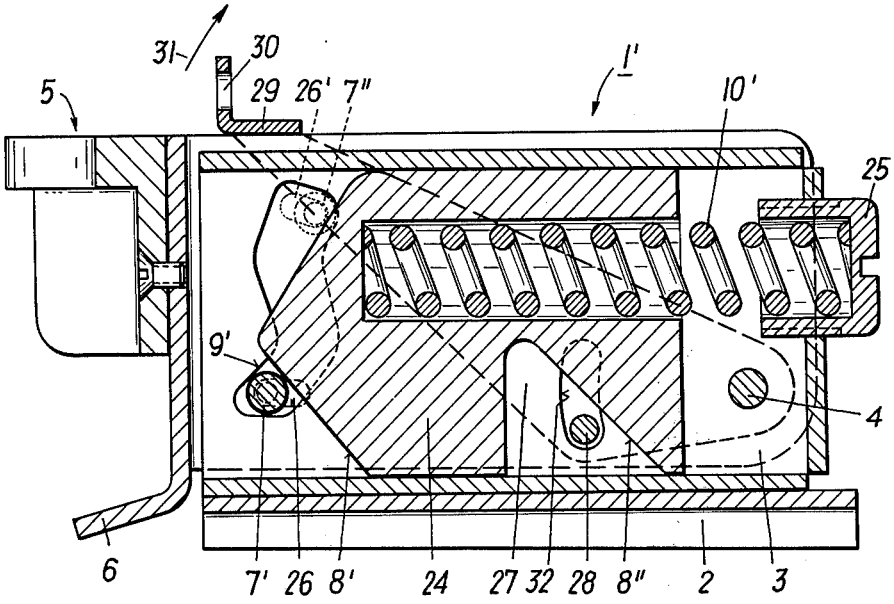
FIG. 4 illustrates a variation of the device for voluntary opening which figure omits certain parts and FIG. 5 is an elevational cross-sectional view of a track and holding element.

In the embodiment shown in FIG. 5, the track 8′ is constructed as part of a slide member 24, which is here loaded by a spring 10′ and can be adjusted by means of an adjusting screw 25. The locking pin 7′ lies in a slotted hole 26 which extends in lengthwise direction of the ski and can be adjusted or moved between the track 8′ and the holding element 9′ in the slotted hole 26 by the action of a force from outside. In the illustrated position, the locking pin 7′ is held in the closed position of the ski binding 1′ by the track 8′ of the slide member 24 and the holding element 9′. Upon the appearance of an outside force, the locking pin 7′ reaches the other end position shown by dashed lines and is able to slide past the bend of the holding part 9′. The disengaged position is only indicated by the dashed position of the locking pin 7″ or the slotted hole 26′.

For the voluntary release, the slide member 24 has a recess 27, which with a track 8″ cooperates with a release pin 28 of a release lever 29. The release lever 29 has in a conventional manner an eyelet 30 to receive a safety strap or the like, by means of which the release lever 29 can be swung in direction of the arrow 31. During this pivoting movement the release pin 28, which is movable in a slotted hole 32 of the bearing block, presses the slide member 24 backwardly against the force of the spring 10′ which causes the track 8′ to release the locking pin 7l′ and the ski boot (not illustrated) is released from the sole holder 5. The elasticity of the ski binding 1′ is determined by the relationship of locking pin 7′ and track 8′ or holding element 9′, whereby the respective elasticity range can be set by adjustment of the spring 10′ by means of the adjusting screw 25. Further details correspond to what has already been described.

The invention is not limited to the illustrated exemplary embodiments. Variations can be carried out, without going beyond the scope of the invention. For example the ski binding can, instead of being arranged fixedly onthe supporting plate 2, be secured movably on same. The holding parts of the track and holding element which grip over one another can also be arranged in toothed engagement with one another, so that several holdng parts are provided on the track or on the holding part. This construction can be advantageous for force distribution. In place of the oval-shaped release member, it is also possible to provide an eccentric which acts only onto the track which is directly loaded by the spring. In this case, the holding element is adjusted by the locking pin during a voluntary release.

The illustrated exemplary embodiment was above discussed in relationship to a heel holder. However, it is also easily conceivable to use the inventive safety ski binding in a front jaw.

In all embodiments, there exists a special advantage in that the release force for adjusting the control angle remains substantially constant.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A safety ski binding, comprising:

a first member a second member which is pivotally connected to said first member so that said first and second members are movable with respect to each other about a pivot axis between a position of use and a release position, said pivot axis extending transversely to the longitudinal direction of a ski;

a pair of spaced track and holding members mounted on said first member, both of said track and holding members being supported for movement relative to each other.

adjustable abutment means mounted on said first member, said adjustable abutment means including an adjustable abutment and connecting means for connecting said adjustable abutment to one of said track and holding members;

resilient means consisting of a single spring engaging and extending between the other of said track and holding members and said adjustable abutment for urging both of said movable track and holding members toward each other;

inclined surface means on at least one of said track and holding members and positioned between said pair of track and holding members and having means defining a threshold part thereon; and locking pin means secured to said second member and positioned between said pair of track and holding members and to engage said inclined surface means at a location spaced from said threshold part when said sole holder is in said position of use, a movement of said sole holding part toward said release position effecting a separation of said pair of track and holding members upon a movement of said locking pin means past said threshold part, said single spring resisting the separation movement of both of said track and holding members.

2. A safety ski binding according to claim 1, wherein other of said track and holding members is a holding members is a holding element secured to said one of said base and said sole holder, said inclined surface means being positioned between said holding element and said adjustable abutment; and said connecting means includes a support member connected to and extending between said one of said track and holding members and said adjustable abutment, an adjustment of said adjustable abutment effecting a longitudinal adjustment of said support member and a change in the spacing between said other of said track and holding members and said adjustable abutment.

3. A safety ski binding according to claim 2, wherein said support member is a rod which extends through aligned openings in said track and holding members and engages side of said one track and holding member which is opposite said inclined surface means.

4. A safety ski binding according to claim 3, wherein said inclined surface means includes a first inclined surface on said other track and holding element and a second inclined surface on said one track and holding element inclined in an opposite direction to said first inclined surface, said locking pin means being positioned to engage both of said inclined surfaces when said second member is in said position of use.

5. A safety ski binding according to claim 2, wherein said adjustable abutment has a first thread thereon and said support member has a cooperating second thread engaged therewith, said adjustable abutment being freely reciprocally mounted on said first member.

6. A safety ski binding according to claim 1, including an elliptic release member positioned between said pair of track and holding members, an external handle secured to said elliptic release member, the narrow dimension of said elliptic release member being spaced from said pair of track and holding members when said locking pin means is positioned in said position of use, a movement of said elliptic member effecting a movement of the large dimensional part of said elliptic release member into engagement with said pair of track and holding members and a separation thereof to permit the free passage of said locking pin means past said inclined surface and said threshold part.

7. A safety ski binding according to claim 1, including an elliptic release member; and wherein each of said pair of track and holding members has a shoulder thereon, said elliptic release member being positioned between said shoulders, a movement of said elliptic member effecting a movement of the large dimensioned part of said elliptic release member into engagement with said shoulders and a separation thereof and said pair of track and holding members.

8. A safety ski binding according to claim 1, wherein said pair of track and holding members are pivotally mounted on said first member and wherein said locking pin means is mounted on said second member.

* * * * *

UNITED STATES PATENT AND TRADEMARK OFFICE

CERTIFICATE OF CORRECTION

PATENT NO. : 4 025 087

DATED : May 24, 1977

INVENTOR(S) : Erwin Krob, Erwin Weigl and Josef Svoboda

It is certified that error appears in the above-identified patent and that said Letters Patent are hereby corrected as shown below:

Column 5, line 5; after "member" insert ---;---.

Column 5, line 15; change "." to ---;---.

Column 5, lines 42, 43, 44, 45, and 46; delete in their entiret

Column 6, line 7; after "engages" insert ---a---.

Signed and Sealed this

*Sixth* Day of *September 197*

[SEAL]

*Attest:*

RUTH C. MASON
*Attesting Officer*

LUTRELLE F. PARKER
*Acting Commissioner of Patents and Trademark*